United States Patent [19]

Bauer

[11] Patent Number: 4,502,348

[45] Date of Patent: Mar. 5, 1985

[54] HAND AND FOOT THROTTLE CONTROL LINKAGE

[75] Inventor: Frederick C. Bauer, Franksville, Wis.

[73] Assignee: Allis-Chalmers Corporation, Milwaukee, Wis.

[21] Appl. No.: 451,607

[22] Filed: Dec. 20, 1982

[51] Int. Cl.[3] ..... G05G 11/00; G05G 5/16

[52] U.S. Cl. ..... 74/482; 74/531

[58] Field of Search ..... 74/481, 482, 480 R, 74/480 B

[56] References Cited

U.S. PATENT DOCUMENTS

| | | | |
|---|---|---|---|
| 3,040,596 | 6/1962 | Du Shane et al. | 74/482 |
| 4,059,025 | 11/1977 | Waack et al. | 74/482 |
| 4,351,198 | 9/1982 | Hansen | 74/482 |

*Primary Examiner*—Allan D. Herrmann

*Attorney, Agent, or Firm*—Arthur L. Nelson

[57] ABSTRACT

A hand and foot throttle control linkage having independent operation of the throttle by either a hand or foot control. A return spring for the foot pedal is carried on the throttle linkage to return the foot pedal to its retracted position and to reduce the application force during operating of the hand throttle lever.

10 Claims, 3 Drawing Figures

HAND AND FOOT THROTTLE CONTROL LINKAGE

This invention relates to a throttle control and more particularly to a hand and foot throttle control linkage having a return spring for the foot pedal carried on the throttle linkage to reduce the application force to operate a hand throttle lever.

A motor vehicle may be provided with a hand or foot throttle control or both. A hand throttle is normally used to set the throttle opening for starting of the engine. It may also be convenient to have a hand throttle to set the working speed where the working speed of the vehicle is relatively constant. If the vehicle speed is variable, it may be more convenient to use a foot throttle. Use of a foot throttle also allows the operator to have the one hand free which normally is used in operating the hand throttle and can be used for other controls on the motor vehicle. The combination of a hand and foot throttle control linkage usually includes some interconnection between the foot control and the hand control. The foot pedal generally is operated against the force of a return spring to assure that the foot pedal is returned to the idle position when the pressure on the foot pedal is released. This is not only convenient but a safety feature since the pedal should follow the movement of the foot. A hand lever is operated manually to preset the lever in any position desired. The stop may be a ratchet stop or a friction stop to provide infinite positioning of the hand throttle. A spring return of the hand throttle is normally not desirable since the throttle lever is set at the predetermined speed desired. Since a spring return for the hand throttle is not desirable and the hand and foot controls are interconnected, it is desirable to provide separate operation. Accordingly, applicant's invention provides for a return spring for the foot pedal which is carried on the throttle linkage and operates only when the foot pedal throttle linkage is operated. When the hand throttle is operated, the return spring is inoperative and the hand throttle can be positioned in any position so desired.

It is an object of this invention to provide a hand lever and foot pedal to operate a throttle for an engine on a vehicle.

It is another object of this invention to provide a hand and foot operated throttle control with a pedal return spring carried on the throttle linkage for returning the foot pedal to its normally retracted position when the foot pressure is released from the pedal and whereby the spring is ineffective when the hand lever is operated.

It is a further object of this invention to provide a hand and foot throttle control linkage for a motor vehicle having friction stop for the hand lever and with a relatively easy operating force for operating the hand lever in a fore and aft direction. The accelerated pedal has an automatic return spring to return the pedal to its normally retracted position when the pedal is released. The return spring is carried on the throttle linkage to return the foot pedal to its retracted position when the pedal is released and to be ineffective when operating the hand throttle.

The Waack et al patent, U.S. Pat. No. 4,059,025, shows a hand and foot throttle control for a motor vehicle. A spring is carried on the linkage for operation of the throttle mechanism. The spring in the linkage allows movement of the foot control to incrementally increase or decrease the throttle speed while permitting the setting of the hand lever for the throttle to remain fixed in its original position. The applicant's invention provides for a solid link in operating the throttle and a spring carried on the linkage which operates as the return spring for the foot pedal as shown in the applicant's invention.

The objects of this invention are accomplished with a foot pedal pivotally mounted for reciprocal movement of a push rod to operate a fuel pump. A hand lever is pivotally mounted for reciprocally operating a cable. The cable operates a pin in the end of a slot of the push rod to operate the fuel pump. When the foot pedal is operated, the pin rides in the slot of the push rod and is connected to a return spring which returns the push rod to its normally retracted position. When the hand throttle lever is operated, it operates the push rod which is included in the throttle linkage and carries the return spring to provide ease of operation of the hand throttle and the return spring is ineffective so it does not effect operation of the hand throttle.

Referring to the drawings, the preferred embodiment of this invention is illustrated.

Figure 1:
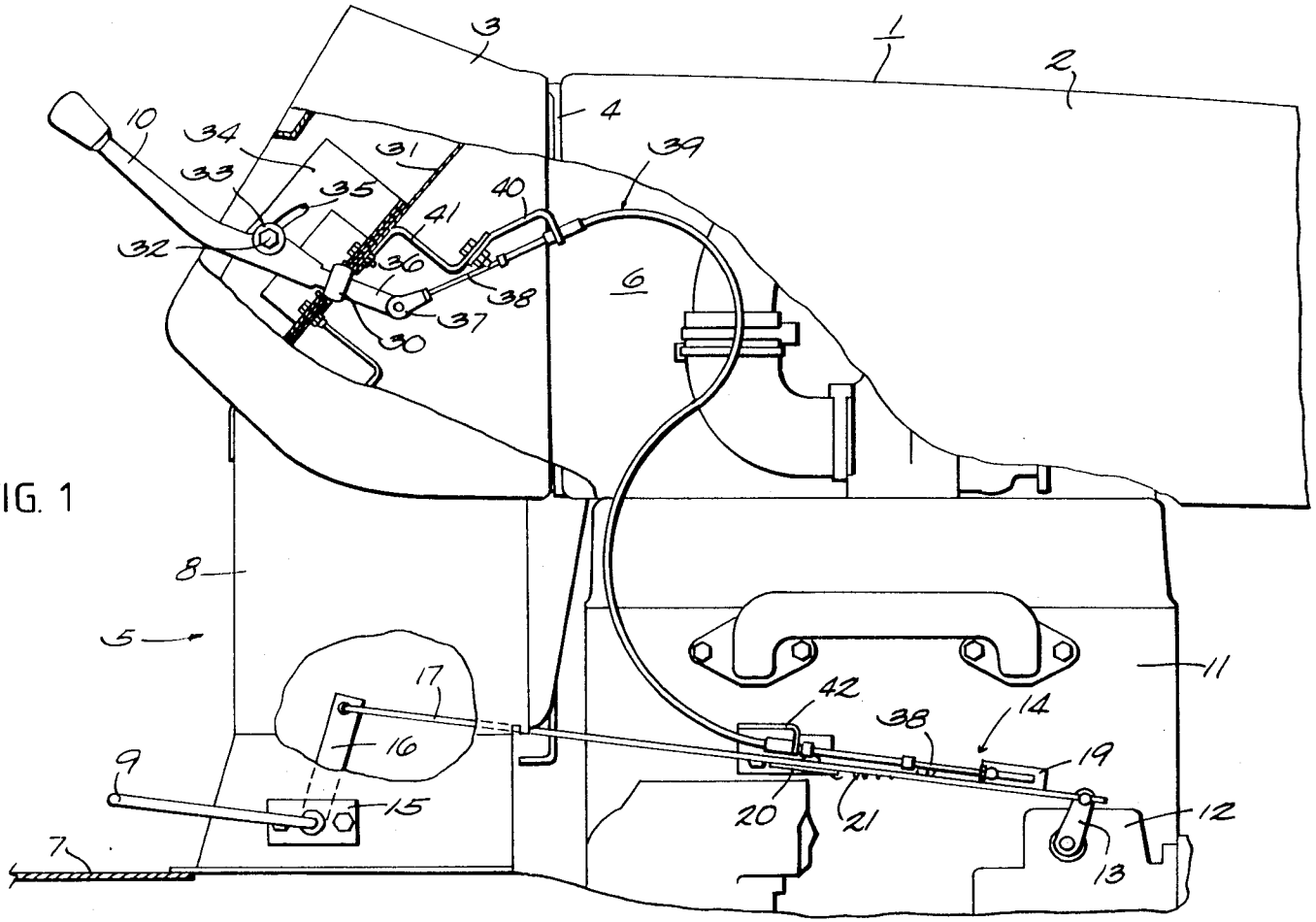
FIG. 1 illustrates a side elevation view of the hand throttle lever and the foot accelerator pedal operating the throttle for the engine.

FIG. 1 illustrates a side elevation view of a tractor 1 having an engine hood 2 connected to the control console 3 at the fire wall 4. The fire wall 4 delineates the operator's station 5 from the engine compartment 6. A platform 7 further defines the operator's station 5. A panel 8 supports the control console 3 which, in turn, provides supporting structure for the accelerator foot pedal 9 and the hand throttle lever 10.

Figure 2:
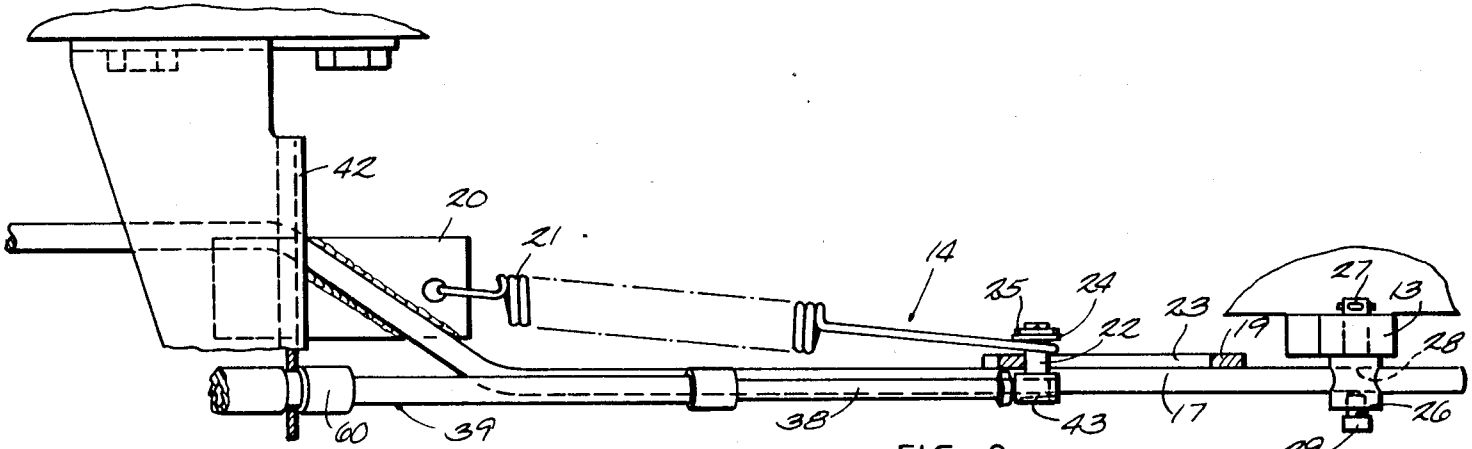
FIG. 2 is a plan view of the throttle control linkage.
Figure 3:
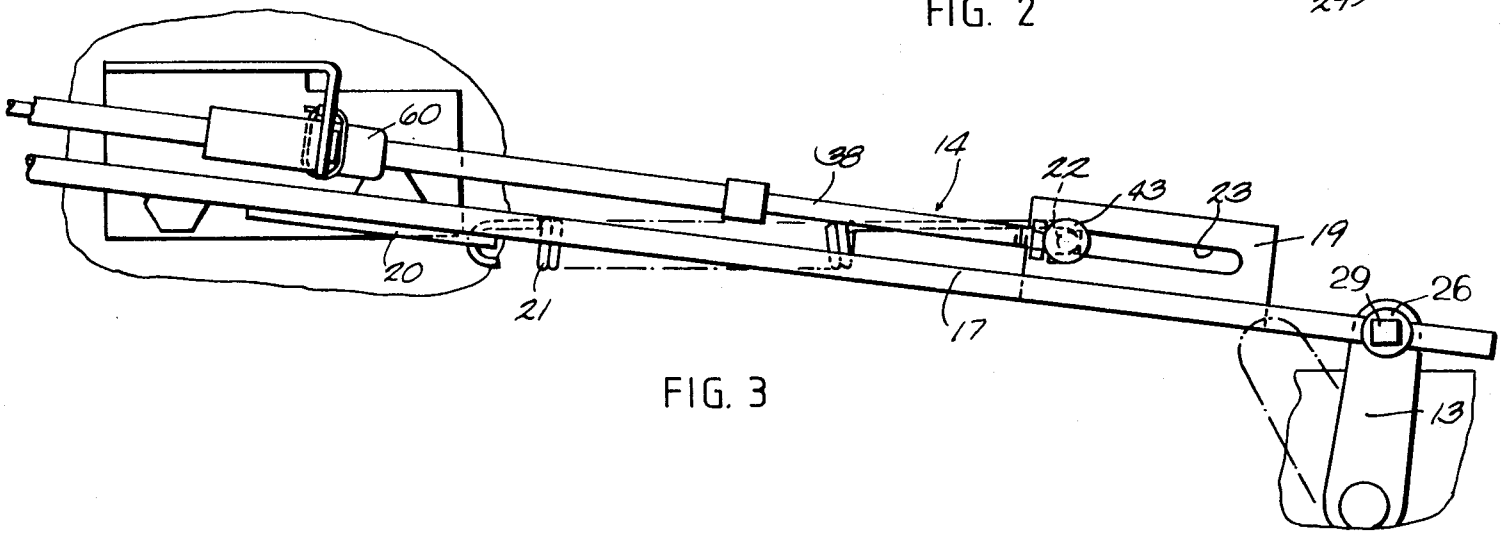
FIG. 3 is a side elevation view of FIG. 2 showing the throttle control linkage.

The engine 11 is mounted in the engine compartment 6 underneath the engine hood 2. A fuel feeding device such as a fuel pump 12 is carried on the engine 11. A throttle arm 13 controls the metering of the fuel to the engine 11. A throttle linkage 14 is operated by the hand throttle lever 10 and the foot accelerator pedal 9. The foot accelerator pedal 9 is pivotally supported in the pedal support bracket 15 on the panel 8 and includes the throttle control arm 16. The throttle control arm 16 is pivotally connected to the push rod 17 which extends forwardly through the fire wall 4 to connect with the throttle arm 13 of the fuel injection pump 12. The push rod 17 carries a slotted plate 19 and a spring anchor plate 20. Spring 21 is connected between the pin 22 carried in the slot 23, in plate 19 and the spring anchor plate 20. The pin 22 and the spring anchor plate 20 are carried on the push rod 17. The spring 21 biases the pin 22 rearwardly in the slot to engage the rear end of the slot as shown in FIG. 2. Pin 22 carries the washer 24 and cotter key 25 to maintain the pin 22 in the assembled position.

A throttle arm 13 on the fuel injection pump 12 is pivotally connected to the push rod 17 through the bolt 26 which carries the cotter key 27. A diametrical opening 28 is formed in the head of the bolt 26 which receives the push rod 17 and is locked in position by the set screw 29.

The hand throttle lever 10 is pivotally mounted on the bearing 30 on the panel 31 in the control console 3. Bolt 32 fastened in the lever 10 carries friction washers 33 on opposing sides of the panel 34 forming the arcuate slot 35. Friction washers 33 are resiliently biased against the sides of the panel 34 to form a friction stop for the lever 10 at an infinite number of positions along the arcuate slot 35. The arcuate slot 35 is arcuate to the pivoting axis of the bearing 30.

The lever arm 36 is pivotally connected to the clevis 37 on the cable 38. Cable 38 is a part of the sheathed cable 39 wherein the sheath 60 is anchored in the anchor 40 which is mounted on the bracket 41 in the control console 3. The sheathed cable 39 extends through the fire wall 4 into the engine compartment 6 where the cable sheath 60 is anchored on the anchor bracket 42 supported on the engine 11. The cable 38 extends forwardly where it is fastened to the head 43 of the pin 22. The pin 22 extends through the slot 23 of the plate 19.

The throttle mechanism operates in the following manner. Normally the return spring 21 connected to the anchor plate 20 and pin 22 maintains the pin 22 in a rearward end of the slot 23 as shown. When the push rod 17 is moved rearwardly, the metering fuel rate increases. When the lever 10 is moved in clockwise direction, as viewed in FIG. 1, the cable 38 is withdrawn from the sheathed cable 39 at the anchor 40. Likewise the cable 38 moves into the sheathed cable 39 at the anchor bracket 42. This in turn moves the push rod 17 rearwardly and rotates the throttle arm 13 counterclockwise. As the throttle arm increases the fuel rate to the engine, the engine speed increases. Likewise, when the throttle control lever 10 is moved in a counterclockwise direction, the cable 38 is reversed and pushed into the sheathed cable 39 at the cable anchor 40. Likewise, the cable 38 extends from the sheathed cable 39 at the cable anchor bracket 42 to rotate the throttle lever 13 in a clockwise direction and decreases the rate of fuel feeding to the engine 11. The friction washers 33 provide stops for the hand throttle lever 10 in an infinite number of positions on the control console 3.

When the accelerator foot pedal 9 is in the position as shown with the hand control lever 10 in its return position as shown in FIG. 1, the return spring 21 retains the pin 22 in the rearward position in the slot 23 of plate 19. As the accelerator foot pedal 9 is depressed it rotates counterclockwise pulling the push rod 17 rearwardly. As the push rod is moved rearwardly, the pin 22 moves forwardly in the slot 23 of plate 19 and the spring 21 is extended. Continued movement of the pedal 9 in a counterclockwise direction moves the push rod 17 rearwardly and rotates the throttle arm 13 of fuel injection pump 12 in a counterclockwise direction. This in turn increases the fuel rate for the fuel injection pump 12 to the engine 11. A continued counterclockwise rotation of the accelerator foot pedal 9 will continue the increasing fuel rate to the engine 11. Release of the accelerator foot pedal 9 allows the return spring to pull the push rod 17 forwardly and allow the pin 22 to move rearwardly in the slot 23 of the plate 19. If the accelerator foot pedal 9 is completely released, the pin 22 will return to its rearward position in the slot 23 of plate 19 and the push rod 17 will move forwardly to the forward limit in which the throttle arm 13 is in the idle position as shown in FIG. 1.

The embodiment of the invention in which an exclusive property or privilege is claimed are defined as follows:

1. A throttle control for an engine on a motor vehicle comprising, a pedal and lever supporting structure between an operator station and an engine compartment, a fuel feeding device having a throttle arm for metering fuel to the engine in said engine compartment, an accelerator pedal pivotally mounted on said pedal and lever supporting structure having a foot operated arm at said operator station and a fuel control arm, a push rod pivotally connected to said control arm and said throttle arm and defining an elongated slot, a hand throttle lever pivotally mounted on said pedal and lever supporting structure, a pin means in said slot for operating the said push rod and throttle arm, a throttle operating member pivotally connected between said hand throttle lever and said pin means for operating said push rod and said throttle arm, a return spring connected between said pin means and said push rod biasing said pin means to one end of said slot and operating as a return spring for said push rod and said accelerator pedal, a stop means for said hand throttle lever on said pedal and lever supporting structure providing positioning of said hand throttle lever when operating said throttle.

2. A throttle control for an engine on a motor vehicle as set forth in claim 1 wherein said throttle operating member pivotally connected between said hand throttle lever and said pin means defines a sheathed cable.

3. A throttle control for an engine on a motor vehicle as set forth in claim 1 wherein said stop means defines resiliently biased friction washers for retaining said hand throttle lever in any of infinite positions.

4. A throttle control for an engine on a motor vehicle as set forth in claim 1 wherein said pedal and lever supporting structure includes a control console for supporting said hand throttle lever.

5. A throttle control for an engine on a motor vehicle as set forth in claim 1 wherein said pedal and lever supporting structure includes a fire wall.

6. A throttle control for an engine on a motor vehicle as set forth in claim 1 wherein said pedal and lever support structure defines a fire wall for supporting said pedal.

7. A throttle control for an engine on a motor vehicle as set forth in claim 1 wherein said throttle operating member defines a sheathed cable, means for anchoring the said sheathed cable at both ends of said cable.

8. A throttle control for an engine on a motor vehicle as set forth in claim 1 wherein said stop means for said hand throttle lever and said throttle operating member operate to hold said return spring for biasing said foot pedal to the retracted position when said foot pedal is released.

9. A throttle control for an engine on a motor vehicle as set forth in claim 1 wherein said throttle operating member defines a sheathed cable, a bracket on said pedal and lever supporting structure for anchoring one end of the sheath of said sheathed cable, a bracket on said engine for anchoring the other end of said sheath of said sheathed cable.

10. A throttle control for an engine on a motor vehicle as set forth in claim 1 wherein said fuel feeding device defines fuel injection pump.

* * * * *